United States Patent [19]

Ishii et al.

[11] Patent Number: 4,835,526

[45] Date of Patent: May 30, 1989

[54] DISPLAY CONTROLLER

[75] Inventors: Takatoshi Ishii, Tokyo; Makoto Kaneko, Hamamatsu, both of Japan

[73] Assignees: Ascii Corporation, Tokyo; Nippon Gakki Seizo Kabushiki Kaisha, Hamamatsu, both of Japan

[21] Appl. No.: 218,463

[22] Filed: Jul. 13, 1988

Related U.S. Application Data

[63] Continuation of Ser. No. 841,093, Mar. 18, 1986, abandoned.

[30] Foreign Application Priority Data

Mar. 19, 1985 [JP] Japan ..... 60-55128

[51] Int. Cl.[4] ..... G09G 1/28

[52] U.S. Cl. ..... 340/703; 340/701; 340/709

[58] Field of Search ..... 340/701, 703, 709, 803

[56] References Cited

U.S. PATENT DOCUMENTS 3,771,155 11/1973 Hayashi et al. ..... 340/709
3,911,419 10/1975 Bates et al. ..... 340/709
4,101,879 7/1978 Kawaji et al. ..... 340/709
4,467,322 8/1984 Bell et al. ..... 340/703

*Primary Examiner*—Donald J. Yusko
*Assistant Examiner*—Jeffery A. Brier
*Attorney, Agent, or Firm*—Cushman, Darby & Cushman

[57] ABSTRACT

A display controller can display a cursor having sufficient contour irrespective of the background color. The display controller has two cursor pattern memories from which first and second cursor patterns are read in such a timing that the first cursor pattern is displayed at a selected position on the screen and that the second cursor pattern is superimposed on the first cursor pattern. The display controller also has two registers storing therein first and second color codes corresponding respectively to the first and second cursor patterns. The color of the first cursor pattern is determined by a color code obtained by subjecting the first color code and a background color code read from a video memory to a logical multiplication, and the color of the second cursor pattern is determined by a color code obtained by subjecting the color code of the first cursor pattern and the second color code to an exclusive-OR operation. The logical operations are selectively effected in accordance with two control bits stored in a register.

6 Claims, 4 Drawing Sheets

| Color Code | Color | RD | | | GD | | | BD | | |
|---|---|---|---|---|---|---|---|---|---|---|
| IRGB | Color | $R_2$ | $R_1$ | $R_0$ | $G_2$ | $G_1$ | $G_0$ | $B_2$ | $B_1$ | $B_0$ |
| 0000 | Black | 0 | 0 | 0 | 0 | 0 | 0 | 0 | 0 | 0 |
| 0001 | Blue | 0 | 0 | 0 | 0 | 0 | 0 | 1 | 0 | 0 |
| 0010 | Green | 0 | 0 | 0 | 1 | 0 | 0 | 0 | 0 | 0 |
| 0011 | Cyan | 0 | 0 | 0 | 1 | 0 | 0 | 1 | 0 | 0 |
| 0100 | Red | 0 | 1 | 1 | 0 | 0 | 0 | 0 | 0 | 0 |
| 0101 | Magenta | 1 | 0 | 0 | 0 | 0 | 0 | 1 | 0 | 0 |
| 0110 | Brown | 1 | 0 | 0 | 0 | 1 | 1 | 0 | 0 | 0 |
| 0111 | White | 1 | 0 | 0 | 1 | 0 | 0 | 1 | 0 | 0 |
| 1000 | Gray | 0 | 0 | 1 | 0 | 0 | 1 | 0 | 0 | 1 |
| 1001 | Light Blue | 0 | 0 | 0 | 0 | 0 | 0 | 1 | 1 | 0 |
| 1010 | Light Green | 0 | 0 | 0 | 1 | 1 | 0 | 0 | 0 | 0 |
| 1011 | Light Cyan | 0 | 0 | 0 | 1 | 1 | 0 | 1 | 1 | 0 |
| 1100 | Light Red | 1 | 0 | 1 | 0 | 0 | 0 | 0 | 0 | 0 |
| 1101 | Light Magenta | 1 | 1 | 0 | 0 | 0 | 0 | 1 | 1 | 0 |
| 1110 | Yellow | 1 | 1 | 0 | 1 | 1 | 0 | 0 | 0 | 0 |
| 1111 | White (High Intensity) | 1 | 1 | 1 | 1 | 1 | 1 | 1 | 1 | 1 |

FIG. 4

DISPLAY CONTROLLER

This is a continuation of application Ser. No. 841,093, filed Mar. 18, 1986, which was abandoned upon the filing hereof.

BACKGROUND OF THE INVENTION

1. Field of the Invention

The present invention relates to a display controller for controlling a liquid crystal display device, a cathode-ray tube (hereinafter referred to as a "CRT") display device or the like.

2. Prior Art

A typical conventional display controller for controlling a liquid crystal display device, a CRT display device or the like has heretofore been arranged such that a cursor is displayed on a screen, and a character or a character pattern is inputted at the position indicated by the cursor, the cursor being movable to any desired position by manipulating keys, a mouse (a coordinate input device) or the like.

This kind of conventional display controller suffers, however, from the problem that when the color of the cursor and the color of the background coincide with each other, the contour of the cursor is unclear, so that it may be impossible to perceive the position of the cursor.

SUMMARY OF THE INVENTION

In view of the above-mentioned circumstances, it is a primary object of the present invention to provide a display controller which enables the cursor to be clearly displayed so that the position of the cursor can be positively identified whatever the color of the background.

According to an aspect of the present invention, there is provided a display controller for use with a scanning-type display device for providing a plurality of display dots on a screen thereof and a memory for storing a plurality of display data each corresponding to a respective one of the display dots, the display controller reading each of the plurality of display data in synchronization with the scanning of the screen, forming a display signal in accordance with the read display data, and supplying the display signal to the display device to thereby display an image on the screen, the display controller comprising first pattern memory means for storing a group of bits representative of a first pattern, for example of a cursor, in the form of a dot-matrix; reading means for reading each of the bits from the first pattern memory means in such a timing that the first pattern is displayed on the screen at a selected position thereof, to form a first pattern timing signal; first register means for storing first data; first logical operation means responsive to the first pattern timing signal for effecting a first logical operation, such as a logical multiplication, on the first data and the display data read from the memory to output a first operation result; and display signal forming means for forming the display signal in accordance with the first operation result. The display controller may further comprises second register means for storing first operation data determining a logical operation manner of the first logical operation, so that the first logical operation means effects the first logical operation in the logical operation manner determined by the first operation data. In this case, each of the display data read from the memory may be a color code representative of a color of a respective one of the display dots provided on the screen, and the first data stored in the first register means may be a color code representative of a color of the first pattern.

The display controller may further comprise second pattern memory means for storing a group of bits representative of a second pattern, for example of the cursor, in the form of a dot-matrix; second reading means for reading each of the bits representative of the second pattern from the second pattern memory means in such a timing that the second pattern is superimposed upon the first pattern displayed on the screen, to form a second pattern timing signal; third register means for storing second data; and second logical operation means responsive to the second pattern timing signal for effecting a second logical operation, such as an exclusive-OR operation, on the second data and the first operation result outputted from the first logical operation means to output a second operation result; and wherein the display signal forming means forming the display signal in accordance with the second operation result. In this case, the display controller may further comprise fourth register means for storing second operation data determining a logical operation manner of the second logical operation, so that the second logical operation means effects the second logical operation in the logical operation manner determined by the second operation data. The second data may be a color code representative of a color of the second pattern.

BRIEF DESCRIPTION OF THE DRAWINGS

FIG. 3-(*c*) is an illustration showing the first and second cursor patterns simultaneously displayed on the screen;

FIG. 4 is a chart showing the relationship between color codes, displayed colors and color data.

DESCRIPTION OF THE PREFERRED EMBODIMENT OF THE INVENTION

One embodiment of the present invention will be described hereunder in detail with reference to the accompanying drawings.

Figure 1:
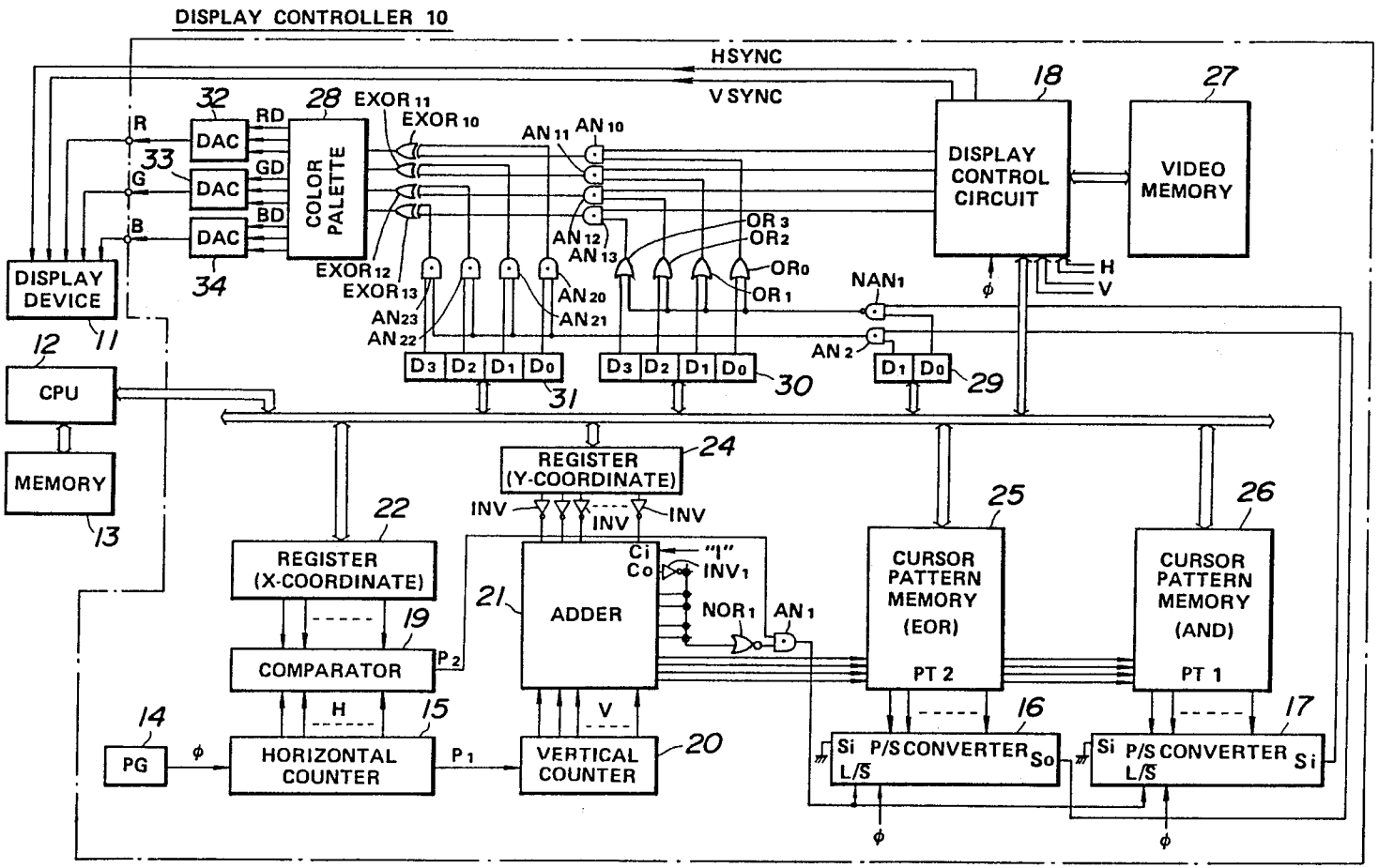
FIG. 1 is a block diagram of a display controller 10 provided in accordance with one embodiment of the present invention.

Referring now to FIG. 1, a display controller 10 provided in accordance with one embodiment of the present invention displays various kinds of dot patterns on a screen of a display device 11, such as a CRT display device and a liquid crystal display device, by effecting transfer of data between the same and a CPU 12 which is an external device to the controller 10. A memory 13 stores data and various programs to be executed by the CPU 12.

Each of the constituent elements of the display controller 10 will be explained below in detail.

A pulse generator 14 generates a train of dot clock pulses $\phi$, the period of which corresponds to the time required to display each dot on a screen of the display device 11. The dot clock pulses $\phi$ are supplied to a horizontal counter 15, parallel-to-serial converters 16 and 17 and a display control circuit 18. The horizontal counter 15 counts the dot clock pulses $\phi$ to provide a count output H which indicates a current horizontal scanning position on the display screen. The count output H of the counter 15 is supplied to both of the display control circuit 18 and a comparator 19. The maximum count of the horizontal counter 15 is set to a value equal to the total number of dots displayed in one horizontal line or row on the display screen, and the counter 15 repeatedly effects the count operation within a count range between the initial value and the the maximum value. When the count output H of the counter 15 returns from the maximum value to the initial value, it supplies a pulse signal $P_1$ to a vertical counter 20. In consequence, a content output V of this vertical counter 20 represents a vertical scanning position on the display screen. The count output V of the vertical counter 20 is supplied to both the display control circuit 18 and an adder 21.

Figure 2:
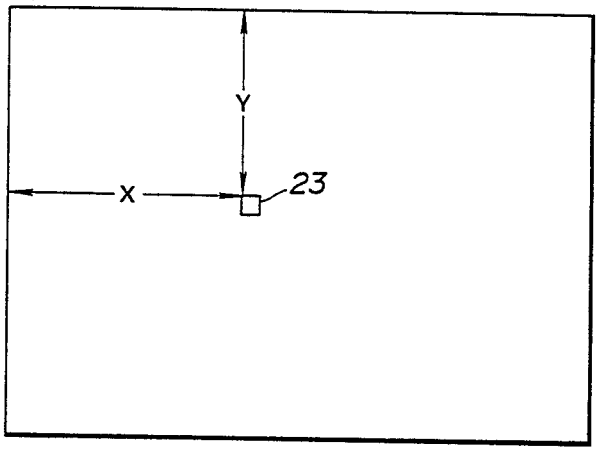
FIG. 2 is an illustration showing a cursor displayed on a screen of the display device 11 of FIG. 1 and coordinates of the cursor.

The comparator 19 compares the count output H with data held in a register 22. If these values are the same, the comparator 19 supplies a coincidence-detection pulse $P_2$ to one input terminal of an AND gate $AN_1$. In this case, the data held in the register 22 represents the present X-coordinate of a cursor 23, as shown in FIG. 2, the data being written into the register 22 by the CPU 12. Similarly, data representing the Y-coordinate of the cursor 23 is written into a register 24 by the CPU 12. Bits of the data held in the register 24 are supplied to the adder 21 through respective inverters INV. A carry input terminal Ci of the adder 21 is always supplied with a "1" signal. Thus, the adder 21 carries out addition of the two's complement of the data held in the register 24 to the count output V. In other words, the adder 21 acts so as to subtract the data in the register 24 from the count output V. Higher-order output terminals of the adder 21 are respectively connected to input terminals of a NOR gate $NOR_1$, and a carry output terminal Co of the adder 21 is connected to a remaining input terminal of the NOR gate $NOR_1$ through an inverter $INV_1$. An output terminal of the NOR gate $NOR_1$ is connected to the other input terminal of the AND gate $AN_1$, and an output terminal of this AND gate $AN_1$ is connected to respective load/shift switching terminals L/S of the parallel-to-serial converters 16 and 17.

When a signal supplied from the AND gate $AN_1$ to the terminals $L/\overline{S}$ rises, the parallel-to-serial converters 16 and 17 stores 16-bit parallel data read from respective cursor pattern memories 25 and 26 thereinto, while when the signal falls or decays, the converters 16 and 17 shift out the stored data from respective output terminals So thereof in accordance with the dot clock pulses $\phi$. The output terminal So of the converter 16 is connected to one input terminal of an AND gate $AN_2$, while the output terminal So of the converter 17 is connected to one input terminal of a NAND gate $NAN_1$. In this case, the output terminals So of the parallel-to-serial converters 16 and 17 are directly connected respectively to the highest-bit stages thereof, and therefore, when the parallel data is loaded onto each of the converters 16 and 17, the highest-order bit of each of the parallel data is outputted at the time of loading thereof. A "0" signal is always supplied to each of serial data input terminals Si of the converters 16 and 17, and therefore, after all of the loaded parallel data have been shifted out, "0" signals are outputted from the output terminals So of the converters 16 and 17.

Figure 3:
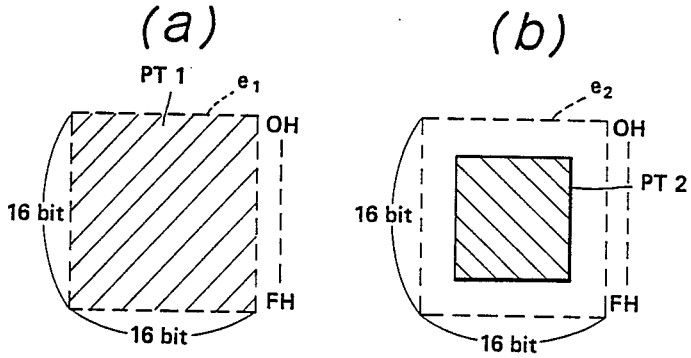
FIGS. 3-(*a*) and 3-(*b*) are illustrations showing configurations of first and second cursor patterns stored respectively in the first and second cursor memories shown in FIG. 1.
Figure 3:
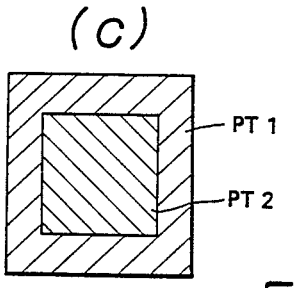

The cursor pattern memories 26 and 25 are 16×16-bit memories for respectively storing cursor patterns PT1 and PT2 having configurations different from each other, the patterns PT1 and PT2 being written into the memories 26 and 25 by the CPU 12. When displayed, the pattern PT2 is superimposed on the pattern PT1. FIGS. 3-(*a*) and 3-(*b*) respectively show examples of the patterns PT1 and PT2. Areas $e_1$ and $e_2$ surrounded by broken lines in FIGS. 3-(*a*) and 3-(*b*) represent memory areas of the cursor pattern memories 26 and 25, respectively. In this case, the pattern PT1 is a 16×16 dot-matrix pattern, while the pattern PT2 is a 10×10 dot-matrix pattern (the hatched portions of the areas $e_1$ and $e_2$ are stored with "1" bits). In actual display, these patterns PT1 and PT2 are superimposed one upon the other, as shown in FIG. 3-(*c*). Address input terminals of each of the cursor pattern memories 25 and 26 are connected respectively to the lower-bit (four bits) output terminals of the adder 21, so that the memories 25 and 26 are accessed by the four lower-order bits simultaneously. However, when the patterns PT2 and PT1 are written by the CPU 12, the addressing of the cursor pattern memories 25 and 26 is controlled by the CPU 12.

A video memory 27 stores an array of four-bit color codes each representing a color of a respective one of the dots provided on the screen of the display device 11. Each of the four-bit color codes is read from and written into the video memory 27 by the display control circuit 18.

FIG. 4 shows the relationship between the color codes and the colors of the dots. RD, GD and BD shown in FIG. 4 respectively denote color data obtained by decoding each color code, the three color data respectively representing intensity level of red, green and blue. The decoding of each color code is executed by a color palette 28.

The display control circuit 18 identifies a current scanning position on the display screen of the display device 11 on the basis of the dot clock pulses $\phi$ and the count outputs H and V of the counters 15 and 20, reads out one of the color codes stored in the video memory 27 which corresponds to the identified scanning position and then outputs the color code read from the memory 27. The display control circuit 18 further outputs a horizontal synchronization signal HSYNC and a vertical synchronization signal VSYNC to the display device 11 on the basis of the count outputs H and V of the counters 15 and 20. In addition, the display control circuit 18 properly rewrites the color codes in the video memory 27 in accordance with various commands supplied from the CPU 12. Four bits constituting a color code outputted from the display control circuit 18 are supplied respectively to one input terminals of AND gates $AN_{10}$ to $AN_{13}$.

The display controller 10 further comprises a 2-bit register 29, a 4-bit register 30 and a 4-bit register 31 whose contents are changed by the CPU 12. Bit data $D_0$ and $D_1$ outputted from the register 29 are supplied to the other or second input terminals of the NAND gate $NAN_1$ and the AND gate $AN_2$, respectively. Four bit data $D_0$ to $D_3$ outputted from the register 30 are supplied to one input terminals of four OR gates $OR_0$ to $OR_3$, respectively, and similarly, four bit data $D_0$ to $D_3$ outputted from the register 31 are supplied to one input terminals of four AND gates $AN_{20}$ to $AN_{23}$, respectively. An output terminal of the NAND gate $NAN_1$ is connected to all of the other input terminals of the OR gates $OR_0$ to $OR_3$, and an output terminal of the AND gate $AN_2$ is connected to all of the other input terminals of the AND gates $AN_{20}$ to $AN_{23}$. Each of the registers 30 and 31 are written with a color code by the CPU 12.

Output terminals of the OR gates $OR_0$ to $OR_3$ are connected respectively to the other input terminals of the AND gates $AN_{10}$ to $AN_{13}$, and output terminal of the AND gates $AN_{10}$ to $AN_{13}$ are connected respectively to one input terminals of four exclusive-OR gates $EXOR_{10}$ to $EXOR_{13}$. Further, output terminals of the AND gates $AN_{20}$ to $AN_{23}$ are connected respectively to the other input terminals of the exclusive-OR gates $EXOR_{10}$ to $EXOR_{13}$, and output signals from the exclusive-OR gates $EXOR_{10}$ to $EXOR_{13}$ are supplied as a color code to input terminals of the color palette 28, wherein the supplied color code is converted into the color data RD, GD and BD. The color data RD, GD and BD outputted from the color palette 28 are passed through digital-to-analog converters $DAC_{32}$ to $DAC_{34}$ so as to be outputted as analog color signals R, G and B, respectively.

The operation of the display controller 10 will now be described.

Figure 5:
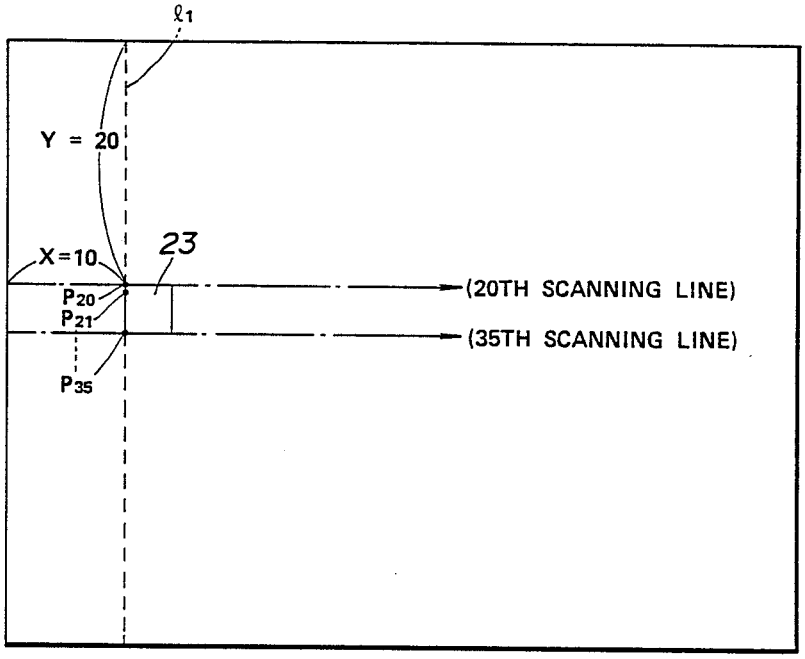
FIG. 5 is a front view of the screen of the display device 11 for explaining the display timing of the cursor 23.

Assuming now that the X- and Y-coordinate data of the cursor 23 stored in the registers 22 and 24 are "10" and "20" in decimal, respectively, the comparator 19 outputs the pulse $P_2$ each time the count output H of the horizontal counter 15 reaches "10" in decimal, that is, each time the horizontal scanning line intersects the imaginary vertical straight line $_1$ shown in FIG. 5. As the horizontal scanning line successively shifts downward from the top of the screen, the count output V of the vertical counter 20 increases, so that the data outputted from the adder 21 is sequentially incremented by one. In this case, the adder 21 carries out a subtraction of the data held in the register 24 from the count output V of the vertical counter 20. Accordingly, until the count output V reaches "20" in decimal, the result of the subtraction effected by the adder 21 is negative, and no carry signal is outputted from the terminal Co of the adder 21. When the count output V reaches "20", the data outputted from the adder 21 is rendered "0", and a "1" signal is outputted from the carry output terminal Co. As a result, "0" signals are supplied to all the input terminals of the NOR gate $NOR_1$, and a "1" signal is consequently outputted from the output terminal of the NOR gate $NOR_1$. In other words, assuming that the uppermost horizontal scanning line is the first horizontal scanning line, a "1" signal is outputted from the output terminal of the NOR gate $NOR_1$ when the 20th horizontal scanning line appears on the screen. The result of the calculation carried out by the adder 21 is "0" when the 20th horizontal line is scanned, and thereafter, each time the horizontal scanning line is shifted downward by one line, for example, from the 20th scanning line to the 21st, or from the 21st to the 22nd, the calculation result of the adder 21 is incremented by one. And therefore, the calculation result is "15" in decimal when the 35th horizontal line is scanned. While the calculation result of the adder 21 is between "0" and "15", the higher-order bits of the output of the adder 21 are all "0", and a "1" signal is outputted from the carry output terminal Co. Consequently, all the input signals to the NOR gate $NOR_1$ are rendered "0", and therefore, a "1" signal is outputted from the NOR gate $NOR_1$. Since the pulse signal $P_2$ is outputted each time a horizontal scanning line intersects the imaginary vertical straight line $l_1$ shown in FIG. 5, the output signal of the AND gate $AN_1$ is rendered "1" when the 20th to 35th horizontal scanning lines intersect the line $l_1$ at display points $P_{20}$ to $P_{35}$ shown in FIG. 5. When a horizontal line disposed downwardly of the 35th horizontal scanning line is scanned, the higher-order bits of the output of the adder 21 includes at least one signal in the state of "1", and therefore from the 36th horizontal scanning line, NOR gate $NOR_1$ never outputs a "1" signal.

When the output signal from the AND gate $AN_1$ rises to "1", the parallel-to-serial converters 16 and 17 store thereinto 16-bit data outputted from the cursor pattern memories 25 and 26, respectively. When the output signal from the AND gate $AN_1$ falls to "0", each of the parallel-to-serial converters 16 and 17 effects a shift operation based on the dot clock pulses $\phi$.

In each of the cursor pattern memories 25 and 26, when the 20th horizontal line is scanned, an address 0H (H represents hexadecimal notation) is accessed, since the four lower-order bits of the output of the adder 21 represent 0H at that time. Similarly, when the four lower-order bits of the output of the adder 21 represent 1H to FH, addresses 1H to FH in each of the cursor pattern memories 25 and 26 are accessed.

Accordingly, the bits of the pattern data of the cursor patterns PT1 and PT2, which are shown in FIGS. 3-(*a*) and 3-(*b*), are successively outputted from the parallel-to-serial converters 17 and 16, respectively, in synchronism with the display timing of those dots on the screen where the cursor 20 is displayed.

The bits of the pattern data thus outputted from the parallel-to-serial converter 17 are successively supplied to the one input terminal of the NAND gate $NAN_1$. When the bit $D_0$ in the register 29 is "0", the signal outputted from the NAND gate $NAN_1$ is "1" regardless of the state of the signal outputted from the parallel-to-serial converter 17. In consequence, the output signals from the OR gates $OR_0$ to $OR_3$ are all "1", and all the AND gates $AN_{10}$ to $AN_{13}$ are enabled to open, so that a four-bit color code outputted from the display control circuit 18 is allowed to pass through the AND gates $AN_{10}$ to $AN_{13}$. On the other hand, when the bit $D_0$ in the register 29 is "1", the NAND gate $NAN_1$ functions as an inverter with respect to the output signal from the parallel-to-serial converter 17. Therefore, when the output signal from the converter 17 is "0", the output signal from the NAND gate $NAN_1$ is "1", and the AND gates $AN_{10}$ to $AN_{13}$ are consequently enabled to open. When the output signal from the converter 17 is "1", the output signal from the NAND gate $NAN_1$ is "0". In this case, the respective output signals from the OR gates $OR_0$ to $OR_3$ are determined in accordance with the color code held in the register 30. In other words, the color code held in register 30 is outputted from the OR gates $OR_0$ to $OR_3$. In consequence, the data outputted from the AND gates $AN_{10}$ to $AN_{13}$ is a logical product of the color code outputted from the display control circuit 18 and the color code which has been written into the register 30. Since the color code outputted from the display control circuit 18 at this time designates the color of the background of the cursor 23, the color code outputted from the AND gates $AN_{10}$ to $AN_{13}$ is a logical product of the color code in the register 30 and the color code of the background color.

As will be clearly understood from the above description, when the bit $D_0$ in the register 29 is "0", the cursor pattern PT1 stored in the cursor pattern memory 26 is not displayed, while when the bit $D_0$ in the register 29 is "1", the cursor pattern PT1 is displayed in a color determined by a logical product of the color code in the register 30 and the color code of background color.

The signal outputted from the parallel-to-serial converter 16 is supplied to the one input terminal of the AND gate $AN_2$. When the bit $D_1$ in the register 29 is "0", the signal outputted from the AND gate $AN_2$ is "0" regardless of the state of the signal outputted from the converter 16, and consequently, all the signals outputted from the AND gates $AN_{20}$ to $AN_{23}$ are rendered "0". Thus, the exclusive-OR gates $EXOR_{10}$ to $EXOR_{13}$ function simply as buffers for the output signals from the AND gates $AN_{10}$ to $AN_{13}$. As a result, the color code outputted from the AND gates $AN_{10}$ to $AN_{13}$ is allowed to pass through the exclusive-OR gates $EXOR_{10}$ to $EXOR_{13}$ and is supplied to the input terminals of the color palette 28.

On the other hand, when the bit $D_1$ in the register 29 is "1", the AND gate $AN_2$ is enabled to open, so that the output signal from the parallel-to-serial converter 16 is allowed to pass through the AND gate $AN_2$ and is supplied to the one input terminals of the AND gates $AN_{20}$ to $AN_{23}$. In consequence, when the output signal from the parallel-to-serial converter 16 is "1", the color code held in the register 31 is supplied to the exclusive-OR gates $EXOR_{10}$ to $EXOR_{13}$. Thus, the color code supplied to the color palette 28 is an exclusive-OR sum of the color code outputted from the AND gates $AN_{10}$ to $AN_{13}$ and the color code in the register 31. When the output signal from the parallel-to-serial converter 16 is "0", all the signals outputted from the AND gates $AN_{20}$ to $AN_{23}$ are "0". Therefore, the color code outputted from the AND gates $AN_{10}$ to $AN_{13}$ is supplied through the exclusive-OR gates $EXOR_{10}$ to $EXOR_{13}$ to the color palette 28.

As will be understood from the above description, when the bit $D_1$ in the register 29 is "0", the cursor pattern PT2 stored in the cursor pattern memory 25 is not displayed, while when the bit $D_1$ of the register 29 is "1", the cursor pattern PT2 is displayed in a color determined by the exclusive-OR sum of the color code outputted from the AND gates $AN_{10}$ to $AN_{13}$ and the color code held in the register 31.

The above-described operation of the display controller 10 in each of the cases where the bits $D_1$ and $D_0$ in the register 29 are "0, 0", "0, 1", "1, 0" and "1, 1" may be summarized as follows.

(1) When the bits $D_1$ and $D_0$ in the register 29 are "0, 0", the output signals from the parallel-to-serial converters 16 and 17 are blocked by the AND gate $AN_2$ and the NAND gate $NAN_1$, respectively. Therefore, the color code outputted from the display control circuit 18 is supplied, through the AND gates $AN_{10}$ to $AN_{13}$ and the exclusive-OR gates $EXOR_{10}$ to $EXOR_{13}$, to the color palette 28. Accordingly, the cursor patterns PT1 and PT2 are not displayed, so that only the background color is displayed at a position on the display screen where the cursor 23 would normally be displayed.

(2) When the bits $D_1$ and $D_0$ in the register 29 are "0, 1", the output signal from the parallel-to-serial converter 16 is blocked by the AND gate $AN_2$, but the signal outputted from the parallel-to-serial converter 17 is inverted by the NAND gate NAN1 and thence supplied to the OR gates $OR_0$ to $OR_3$ Accordingly, the cursor pattern PT1 is displayed in a color determined by the logical product of the color code of the background color and the color code held in the register 30. If a color code "0000" representative of black is written into the register 30 in advance, all the output signals from the AND gates $AN_{10}$ to $AN_{13}$ are rendered "0" whatever the color of the background may be, and therefore the cursor pattern PT1 is displayed in black.

(3) When the bits $D_1$ and $D_0$ in the register 29 are "1, 0", the output signal from the parallel-to-serial converter 17 is blocked by the NAND gate $NAN_1$, but the output signal from the parallel-to-serial converter 16 is supplied to the AND gates $AN_{20}$ to $AN_{23}$ through the AND gate $AN_2$. Accordingly, the cursor pattern PT2 is displayed in a color determined by the exclusive-OR sum of the color code of the background color and the color code held in the register 31. When the background color is, for example, red and when the color code in the register 31 represents high-intensity white, the color codes "0100" and "1111" are subjected to an exclusive-OR operation, and the cursor pattern PT2 is displayed in a color represented by the color code "1011", that is, light cyan.

(4) When the bits $D_1$ and $D_0$ in the register 29 are "1, 1", the output signals from the parallel-to-serial converters 16 is supplied to the AND gates $AN_{20}$ to $AN_{23}$ and the output signal from the parallel-to-serial converter 17 is inverted and supplied to the OR gates $OR_0$ to $OR_3$. Accordingly, both the cursor patterns PT1 and PT2 are displayed on the display screen simultaneously. If, in this case, the color code held in the register 30 represents, for example, black, and if the color code in the register 31 represents, for example, high-intensity white, the cursor pattern PT1 shown in FIG. 3-(*c*) is displayed in black, and the cursor pattern PT2, superimposed on the cursor pattern PT1, is displayed in a color determined by the exclusive-OR sum of the color codes respectively representing black and high-intensity white. However, since the exclusive-OR sum of the color code "0000" representative of black and the color code "1111" representative of high-intensity white produces a color code which represents high-intensity white "1111", the cursor pattern PT2 in this case is displayed in high-intensity white represented by the color code held in the register 31. In other words, the cursor 23 in this case is displayed by a pattern which is a white square edged with black. And in this case, as the cursor patterns PT1 and PT2 can be always displayed in different colors so long as proper color codes are written into the registers 30 and 31, the position of the cursor 23 can certainly be identified whatever the background color may be.

Thus, with the structure of the display controller 10, the cursor patterns PT1 and PT2 can be selectively displayed on the screen by storing proper bits $D_1$ and $D_0$ in the register 29. In addition, it is also possible to change the colors of the cursor patterns PT1 and PT2 by storing proper color codes in the registers 30 and 31.

Although the above description has been given as to only the display of the cursor 23, it is to be noted that the present invention should not necessarily be limited to the display of a cursor and may, of course be applied to the display of various kinds of animation images or patterns which move on a display screen.

What is claimed is:

1. A display controller for use with a scanning-type display device for providing a plurality of display dots on a screen thereof and a memory for storing a plurality of display data, each corresponding to a respective one of the display dots to determine a color thereof, said display controller reading each of said plurality of display data in synchronization with the scanning of the screen, forming a display signal in accordance with the read display data, and supplying the display signal to the display device to thereby display an image on the screen, said display controller comprising:

first pattern memory means for storing a group of bits representative of a first pattern of a cursor on a screen as a dot matrix;

reading means for reading said group of bit from said first pattern memory means at a timing such that said first pattern will be displayed on the screen at a selected position thereof, to form a first pattern timing signal;

first register means for storing first data representative of a first color;

first logical operation means, responsive to said first pattern timing signal, for changing a color of a first portion of said display data stored in said first pattern memory means corresponding to said first pattern, to a changed color by effecting a first logical operation between said first data and said display data to output a modified display data;

second pattern memory means for storing a second group of bits representative of a second pattern of said cursor as a dot-matrix;

said reading means including means for reading said second group of bits representative of said second pattern from said second pattern memory means at a timing such that said second pattern will be superimposed upon said first pattern displayed on the screen to form a second pattern timing signal;

second register means for storing second data representative of a second color;

second logical operation means, responsive to said second pattern timing signal, for changing a color of a second portion of said display data which corresponds to said second pattern, which is within said first pattern from said color to another color, by effecting a second logical operation between said second data and said first operation result outputted from said first logical operation means, to output further modified display data; and display signal forming means for forming the display signal in accordance with said further modified display data.

2. A display controller according to claim 1, wherein said first logical operation means includes means for selectively performing a logical operation based on first operation data applied thereto, and further comprising third register means coupled to said performing means, for storing said first operation data to determine a specific logical operation performed in said first logical operation, so that said first logical operation means effects said specific logical operation commanded by said first operation data.

3. A display controller according to claim 2, wherein said first logical operation is a logical multiplication.

4. A display controller according to claim 1, wherein said second logical operation means includes means for selectively performing a logical operation based on second operation data applied thereto, further comprising fourth register means, coupled to said performing means, for storing said second operation data to determine a specific logical operation performed in said second logical operation, so that said second logical operation means effects said specific logical operation commanded by said second operation data.

5. A display controller according to claim 4, wherein said second logical operation is an exclusive-OR operation.

6. A display control as in claim 1, wherein said second pattern is displayed as a center part of said cursor.

* * * * *